United States Patent [19]

Kanazaka

[11] 4,288,890

[45] Sep. 15, 1981

[54] HOOK FOR A HOOK-AND-EYE FASTENER

[75] Inventor: Yoshihiro Kanazaka, Nyuzen, Japan

[73] Assignee: Yoshida Kogyo K. K., Tokyo, Japan

[21] Appl. No.: 148,729

[22] Filed: May 12, 1980

[30] Foreign Application Priority Data

Jun. 15, 1979 [JP] Japan ..... 54-81930[U]

[51] Int. Cl.[3] ..... A44B 13/00; A44B 1/42

[52] U.S. Cl. ..... 24/227; 24/96; 24/201 HE

[58] Field of Search ..... 24/201 HE, 227, 90 R, 24/90 A, 90 E, 94, 95, 96, 101 R, 101 B, 107, 108, 113 R, 113 MP

[56] References Cited

U.S. PATENT DOCUMENTS 1,988,233 1/1935 Berrendt ..... 24/107

3,045,309 7/1962 Johnson, Sr. ..... 24/94

FOREIGN PATENT DOCUMENTS 51-13902 of 1976 Japan .

1426366 2/1976 United Kingdom ..... 24/227

*Primary Examiner*—Alexander Grosz

*Attorney, Agent, or Firm*—Hill, Van Santen, Steadman Chiara & Simpson

[57] ABSTRACT

A hook for a hook-and-eye fastener comprises a body including a base having a plurality of angularly spaced prongs for penetrating a garment fabric, and a circular retainer including a central raised portion having a plurality of angularly spaced ridges, an intermediate flaring portion extending outwardly from the central raised portion, and an annular peripheral lip portion extending from the intermediate flaring portion and directed toward the central raised portion. Each of the prongs is located between two of the adjacent ridges and has a bent end portion disposed in a retainer pocket defined jointly by the intermediate and lip portions in surrounding relation to the central raised portion.

6 Claims, 9 Drawing Figures

HOOK FOR A HOOK-AND-EYE FASTENER

BACKGROUND OF THE INVENTION

1. Field of the Invention,

The present invention relates to a hook for a hook-and-eye fastener, engageable with an eye for fastening garment pieces together.

2. Prior Art

As disclosed in Japanese Utility Model Laid-Open Publication No. 51-13902, one known hook for a hook-and-eye fastener includes a plurality of prongs on a hook base that penetrate a garment fabric and have bent end portions retained in a retainer. The retainer however tends to be displaced angularly with respect to the hook base in repeated use of the hook-and-eye fastener. Accordingly, the hook can become loosened on the garment to such an extent that it will not reliably and speedily catch the companion eye of the hook-and-eye fastener.

SUMMARY OF THE INVENTION

A hook for a hook-and-eye fastener comprises a circular retainer including a central raised portion having a plurality of angularly spaced ridges extending radially outwardly and between which there are located a plurality of angularly spaced prongs for extending through a garment fabric from a separate hook body. The prongs are held in lateral engagement with the ridges such that the retainer and the hook body are assembled together against relative angular movement therebetween.

It is an object of the present invention to provide a hook for a hook-and-eye fastener, which can be attached securely to a garment fabric.

Another object of the present invention is to provide a hook for a hook-and-eye fastener, which includes a hook body and a decorated retainer secured together against angular relative movement.

Still another object of the present invention is to provide a hook for a hook-and-eye fastener, which is positionally stable on a garment fabric against joggling.

Many other advantages, features and additional objects of the present invention will become manifest to those versed in the art upon making reference to the detailed description and the accompanying drawings in which a preferred embodiment incorporating the principles of the present invention is shown by way of illustrative example.

DETAILED DESCRIPTION

Figure 1:
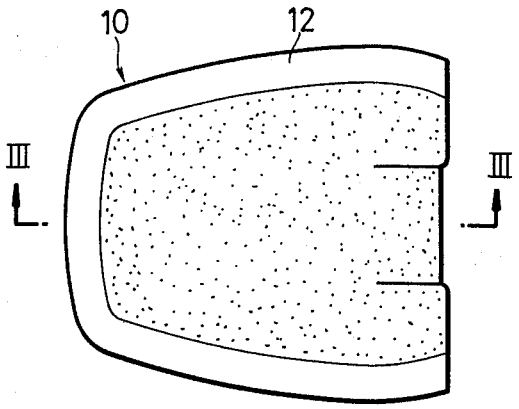
FIG. 1 is a front elevational view of a body of a hook for a hook-and-eye fastener.
Figure 2:
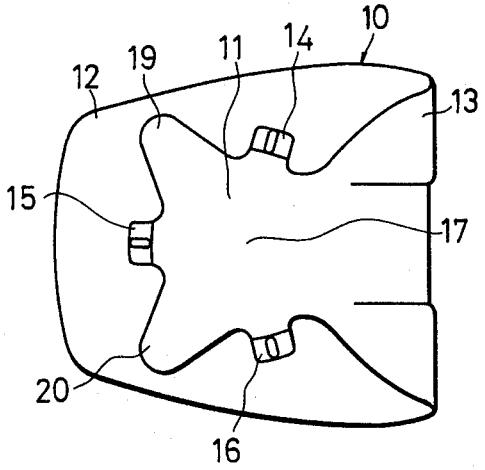
FIG. 2 is a rear elevational view of the hook body shown in FIG. 1.
Figure 3:
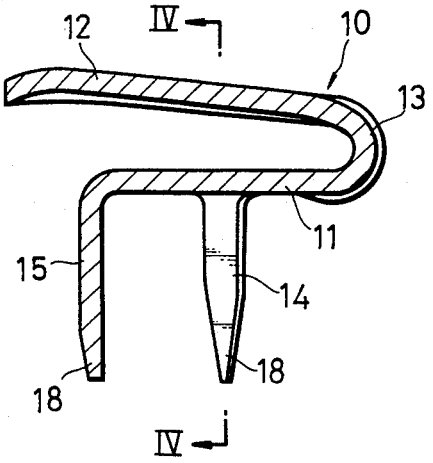
FIG. 3 is a cross-sectional view taken along line III—III of FIG. 1.
Figure 4:
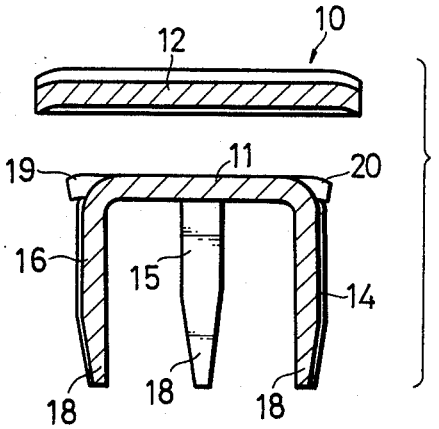
FIG. 4 is a cross-sectional view taken along line IV—IV of FIG. 3.

FIGS. 1 through 4 show a hook body 10 of a hook for a hook-and-eye fastener for fastening two pieces of a garment. The hook body 10 comprises a base 11, a locking member 12 lying substantially parallel to the base 11, and an intermediate bent portion 13 extending between the base 11 and the locking member 12.

A plurality of prongs 14,15,16 (three in the illustrated embodiment) project substantially perpendicularly from the base 11 in a direction away from the locking member 12. The prongs 14–16 are angularly spaced about the center 17 of the base 11 and each has a pointed end portion 18. A pair of tongues 19,20 extend from the base 11 radially outwardly away from the base center 17 and lie in substantially coplanar relation to the base 11. The tongues 19,20 are positioned between the prongs 14,15 and between the prongs 15,16, respectively.

Figure 6:
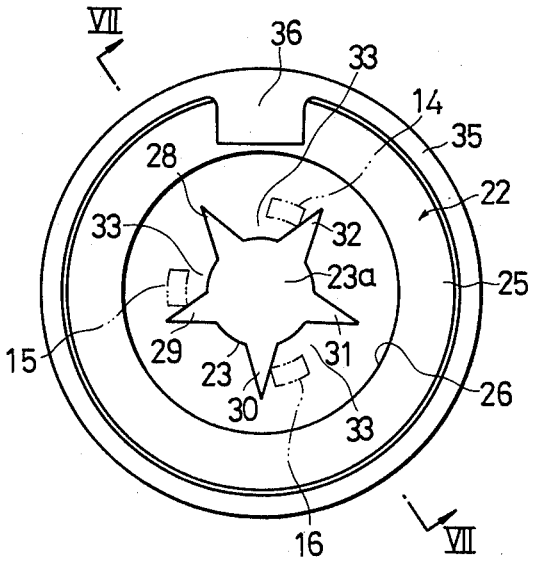
FIG. 6 is a rear elevational view of a hook retainer shown in FIG. 5.
Figure 7:
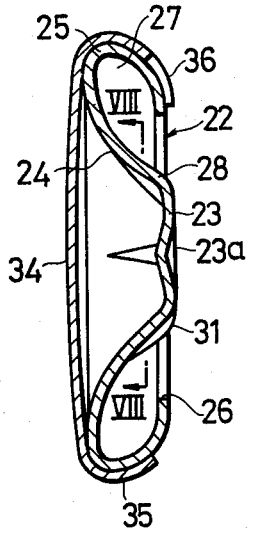
FIG. 7 is a cross-sectional view taken along line VII—VII of FIG. 6.

As shown in FIGS. 6 and 7, a substantially circular retainer 22 includes a central raised portion 23, an intermediate flaring portion 24 extending radially outwardly from the central raised portion 23, and an annular peripheral lip portion 25 extending from the intermediate flaring portion and bent radially inwardly toward the central raised portion 23. The lip portion 25 terminates in an annular edge 26 radially spaced from the central raised portion 23 in confronting relation thereto. The intermediate flaring portion 24 and the annular lip portion 25 jointly define an annular retainer pocket 27 surrounding the central raised portion 23.

Figure 8:
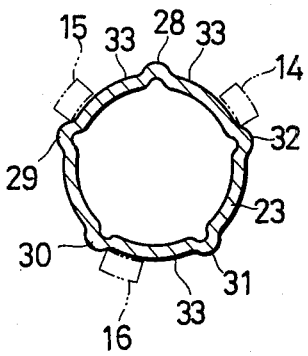
FIG. 8 is a cross-sectional view taken along line VIII—VIII of FIG. 7.

The central raised portion 23 has a plurality of angularly spaced ridges 28–32 (five in the illustrated embodiment) extending radially outwardly from the upper surface **23*a* of the central raised portion 23 and blending into the intermediate flaring portion 24. As illustrated in FIGS. 6 and 8, any adjacent pair of the ridges 28–32 jointly define a laterally bounded, radial surface 33** therebetween.

Figure 5:
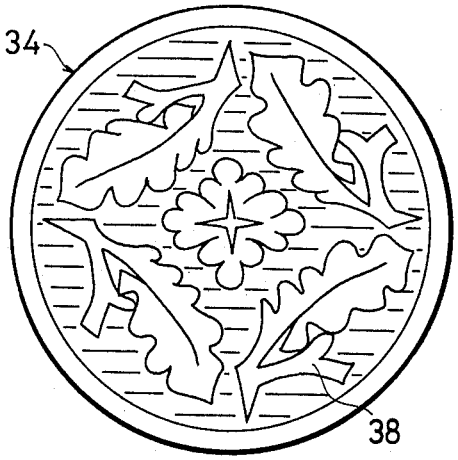
FIG. 5 is a front elevational view of an ornamental cap for a retainer of a hook for a hook-and-eye fastener.

As shown in FIGS. 5 through 7, a circular ornamental cap 34 having a decorative pattern 38 is fitted over the retainer 22 remotely from the central raised portion 23. The ornamental cap 34 has an annular peripheral flange 35 extending around the lip portion 25 of the retainer 22. A tab 36 extends radially from the flange 35 and is directed toward the center of the retainer 22 upon assembling of the ornamental cap 34 on the retainer 22. The retainer 22 and the ornamental cap 34 are assembled together so that the tab 36 is positioned angularly between an adjacent pair of the ridges 28,32.

Figure 9:
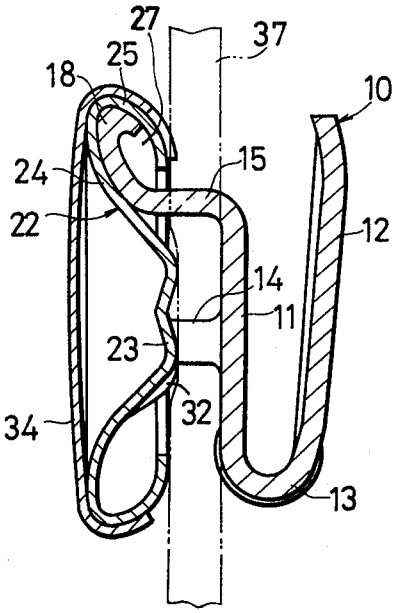
FIG. 9 is a cross-sectional view of an assembled hook.

As shown in FIG. 9, the prongs 14–16 on the hook body 10 penetrate a garment fabric 37 and extend through an annular opening defined between the central raised portion 23 and the annular edge 26 of the lip portion 25. The end portion 18 of each prong 14–16 is deformed by being bent along the intermediate and lip portions 24,25 within the pocket 27. The hook body 10 and the retainer 22 thus securely attached together, with the garment fabric 37 disposed therebetween, constitute a hook engageable with a loop or eye (not shown) attached to another garment fabric. During assembling of the hook body 10 and the retainer 22, the tab 36 can serve as a locating aid for placing the retainer 22 in a proper angular position with respect to the hook body 10 such that the decorative pattern 38 is properly oriented on the garment fabric 37.

The pair of tongues 19,20 are held in substantially flatwise engagement with the garment fabric 37 for providing positional stability of the hook body 10 on the garment fabric 37. Furthermore, the garment fabric 37 is firmly sandwiched over a relatively large area thereof between the tongues 19,20 and a portion of the annular edge 26, between the base 11 and the central raised portion 23, and between the intermediate bent portion 13 and a portion of the annular edge 26. The hook is therefore secured positionally stably against the garment 37 to limit or prevent joggling regardless of repeated use over a prolonged period of time.

As shown in FIGS. 6 and 8, each of the prongs 14–16 is located on one of the radial surfaces 33 and held in lateral engagement with one of the ridges 28–32. More specifically, the prong 14 laterally engages the ridge 32 along a right edge of the prong 14, the prong 15 laterally engages the ridge 29 along a left edge of the prong 15, and the prong 16 laterally engages the ridge 30 along a left edge of the prong 16. Accordingly, relative angular movement between the retainer 22 and the hook body 10 is prevented, either in a clockwise or a counterclockwise direction.

Although various minor modifications may be suggested by those versed in the art, it should be understood that I wish to embody within the scope of the patent warranted hereon, all such embodiments as reasonably and properly come within the scope of my contribution to the art.

I claim as my invention:

1. A hook for a hook-and-eye fastener, comprising:

(a) a body including a base having a plurality of prongs projecting therefrom at spaced intervals; and (b) a retainer including a central raised portion, an intermediate flaring portion extending outwardly from said central raised portion, and a peripheral bent lip portion extending from said intermediate flaring portion inwardly toward said central raised portion, said intermediate and bent lip portions jointly defining a retainer pocket surrounding said central raised portion, said central raised portion having a plurality of spaced ridges, each of said prongs being located between two of the adjacent ridges and having a bent end portion disposed in said retainer pocket, said base including a plurality of tongues each projecting radially outwardly between two of the adjacent prongs and lying in substantially the same plane as said base.

2. A hook according to claim 1, said prongs being angularly spaced, and said ridges being angularly spaced and extending radially outwardly into lateral engagement with said prongs.

3. A hook according to claim 1, said ridges being greater in number than said prongs.

4. A hook for a hook-and-eye fastener, for attachment to a garment fabric, comprising:

(a) a body including a base adapted to be placed on one side of the garment fabric and having a plurality of angularly spaced prongs adapted to penetrate the garment fabric; and (b) a substantially circular retainer adapted to be placed on the other side of the garment fabric and including a central raised portion having a plurality of angularly spaced ridges, an intermediate flaring portion extending radially outwardly from said central raised portion, and an annular peripheral lip portion extending from said intermediate flaring portion and directed radially inwardly toward said central raised portion, said intermediate and lip portions jointly defining a retainer pocket surrounding said central raised portion, each of said prongs being adapted to be located between two of the adjacent ridges and to have an end portion disposed in and bent in said retainer pocket, said base including a plurality of tongues each projecting radially outwardly between two of the adjacent prongs and lying in substantially the same plane as said base for engagement with the garment fabric.

5. A hook according to claim 4, said ridges being laterally engageable with said prongs.

6. A hook according to claim 4, said ridges being greater in number than said prongs.

* * * * *